United States Patent [19]

Meslin et al.

[11] Patent Number: 4,548,440

[45] Date of Patent: Oct. 22, 1985

[54] PORTABLE CHAIR AND IMPROVED TRAY WITH LOCKING CONTAINER

[76] Inventors: Jacques P. Meslin; Laurence C. Meslin, both of 1540 Harksell Rd., Ferndale, Wash. 98248

[21] Appl. No.: 607,300

[22] Filed: May 4, 1984

Related U.S. Application Data

[63] Continuation-in-part of Ser. No. 513,036, Jul. 12, 1983, abandoned, and Ser. No. 495,525, May 17, 1983.

[51] Int. Cl.[4] ..... A47B 39/00

[52] U.S. Cl. ..... 297/174; 108/26

[58] Field of Search ..... 297/174, 152, 153; 108/26

[56] References Cited

U.S. PATENT DOCUMENTS

| | | | |
|---|---|---|---|
| 2,451,667 | 10/1948 | Ducey | 297/174 |
| 2,684,110 | 7/1954 | Stone | 108/26 |
| 3,222,104 | 12/1965 | Remington et al. | 297/174 X |
| 3,253,860 | 5/1966 | Shapiro | 297/174 X |
| 4,230,362 | 10/1980 | Euwema et al. | 297/174 |

FOREIGN PATENT DOCUMENTS

| | | | |
|---|---|---|---|
| 1176417 | 1/1970 | United Kingdom | 297/174 |

*Primary Examiner*—William E. Lyddane
*Assistant Examiner*—Laurie K. Cranmer
*Attorney, Agent, or Firm*—Seed & Berry

[57] ABSTRACT

A portable chair and tray system for use in conjunction with a substantially flat surface is disclosed. The chair is a "hook-on" chair having a pair of substantially parallel elongated members, each of the members having a downwardly extending upper end portion and an upwardly extending lower end portion which are positioned to substantially oppose one another when placed on opposite sides of the surface, the portions acting in a counter-balanced fashion. Detachably coupled to the frame is a seat and an uwpardly extending back. The system is also provided with a tray having openings therein adapted to receive the upper end portions of the elongated members in a nesting position, the tray also having retaining means thereon for releasably retaining a suitable container.

6 Claims, 3 Drawing Figures

FIG. 1
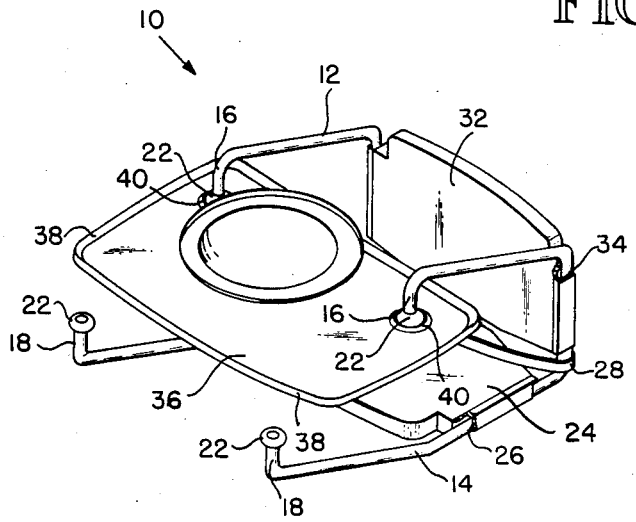
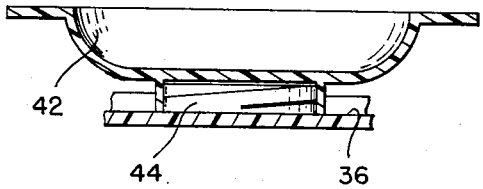
FIG. 3
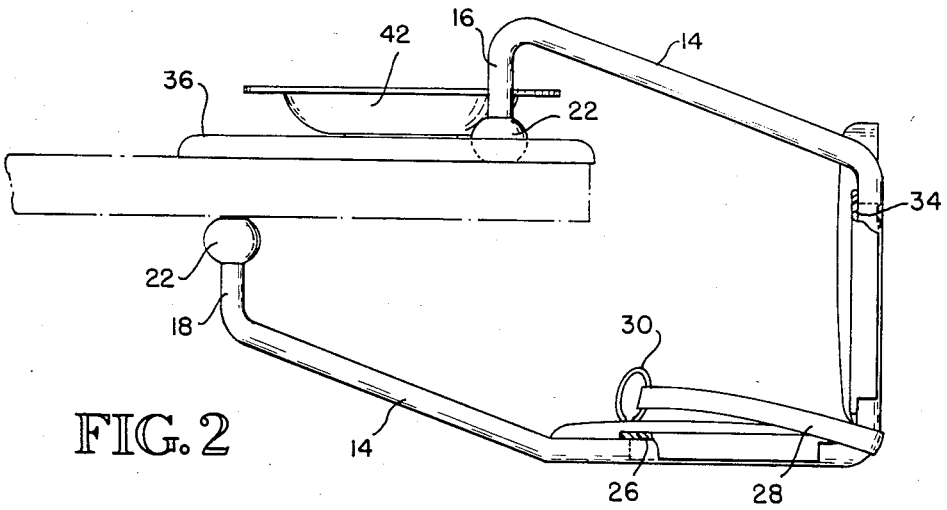
FIG. 2

PORTABLE CHAIR AND IMPROVED TRAY WITH LOCKING CONTAINER

CROSS REFERENCE TO RELATED APPLICATION

This application is a continuation-in-part of applicant's copending application Ser. No. 513,036, filed July 12, 1983, which application is now abandoned and application Ser. No. 495,525, filed May 17, 1983.

TECHNICAL FIELD

The present invention relates to an infant feeding system in general, and more specifically, to a portable and collapsible infant chair in combination with an improved tray for detachably securing food containers thereon.

DISCLOSURE OF INVENTION

Briefly stated, the present invention consists of a portable infant feeding chair for use in conjunction with a substantially flat surface, such as a table. The chair is a conventional hook-on chair consisting of a pair of frame members, each of the members having an upper outwardly extending portion which terminates in a downwardly extending upper-end portion and a lower outwardly extending portion which terminates in an upwardly extending lower portion. When the end portions are placed in position on opposite sides of a flat surface, such as a table, they substantially oppose one another, acting in a counter-balanced fashion to hold the chair securely in place. Extending transverse to and releasably coupled to the frame members is a seat which is positioned substantially parallel to the surface of the table, and an upweardly extending back which is positioned substantially perpendicular to the surface of the table. The chair also includes a tray having openings therein adapted to receive the upper-end portions of the frame members in a nesting position, the tray also having a threadable portion thereon for threadably receiving a mateable food container, such as a bowl in a positively locking manner.

A principal advantage of this invention is the ability to lock a tray and bowl in place on a surface by the weight of an infant placed in a "hook-on" chair so that there is no way the infant can move either the bowl or the tray.

BRIEF DESCRIPTION OF THE DRAWINGS

FIG. 1 is an isometric view of a feeding system embodying the present invention.

FIG. 2 is a side elevational view of the system of FIG. 1.

FIG. 3 is an enlarged cross-sectional view of a food container threadably attached to retaining means on the tray.

BEST MODE FOR CARRYING OUT THE INVENTION

In reference to FIG. 1, the chair, generally referred to as a "hook-on chair", utilizes a pair of substantially parallel frame members 12 and 14 which form a frame for the system, each of the frame members having an upper outwardly extending portion which terminates in a downwardly extending upper-end portion 16 and a lower outwardly extending portion which terminates in an upwardly extending lower portion 18. The frame members 12 and 14 are preferably tubular in nature and made of steel or aluminum or other similar lightweight metal of sufficient rigidity to act as a suitable support structure in this context. At each of the termini of the upper-end portions 16 and lower portions 18 is an ellipsoidal, flexible cap 22. The caps 22 are preferably made of rubber so as to be resilient under pressure as well as retaining anti-skid properties when in contact with the surfaces of a table.

Extending transverse to and releasably coupled to the frame members 12 and 14 is a seat 24. The seat 24 is preferably formed of a substantially rigid break-resistant plastic that is relatively easy to clean. As shown in FIG. 2, the seat includes a pair of resilient channels 26 to attach to the frame members 12 and 14 through a spring-like action, the seat being positioned so as to be substantially parallel to the plane formed by the surface of the table.

Extending transverse to and releasably coupled to the frame members 12 and 14 is an upwardly extending back 32. The back 32, like the seat 24, is also preferably formed of a substantially rigid break-resistant plastic that is relatively easy to clean. As shown in FIG. 2, the back is attached to the frame members 12 and 14 through the use of a pair of resilient channels 34 similar to the seat 24 the back being positioned so as to be substantially perpendicular to the plane formed by the surface of the table.

When the frame, seat and back cooperate in the manner noted above, the weight of an infant seated within the chair (up to forty pounds) provides the force necessary to positively lock the chair in place at the table due to the opposing forces distributed through the upper-end portion and lower portion of the frame members which act in a counter-balanced fashion.

The seat 24 may also be provided with a safety strap 28 removably attached to the frame members or the seat, and which extends across the seat and is provided with a suitable adjustable locking system. To aid in securing a child in position within the chair, the safety strap may also include a center strap 30, best shown in FIG. 2, which is removably attached to the center of the seat 24 to slidably retain the safety strap substantially adjacent to the seat, but of sufficient length to allow a child's legs to pass comfortably between the seat and the safety strap.

As shown in FIGS. 1 and 2, a tray 36 is utilized to aid in confining to a limited area various items such as utensils and foodstuffs (not shown) without interferring with the anti-skidding effect of the rubber caps 22 in direct contact with the table. To further facilitate this function, the tray may be fashioned with an upwardly beveled edge 38. The tray has a planar surface with no grooves or recesses and is formed of a durable break-resistant and heat-resistant plastic which is relatively easy to wipe clean.

The tray 36 is secured in position on a table through downward pressure exerted thereon by the upper-end portions 16 with their associated flexible caps 22 which extend through a pair of openings 40 therein. The caps 22 and the corresponding openings 40 may be circular as shown in FIG. 1 or may have a variety of other shapes, such as rectangular or square. The caps and openings are shaped in such a way that the caps apply substantial downward pressure on the sidewalls of the openings 40 of the tray only after they have been compressed under the load provided by the weight of an infant seated in the chair. In addition, the shape of the caps 22 and the openings 40 are matched such that the contact of the caps 22 with the surface of the table is not substantially affected, thus not diminishing the caps natural anti-skid properties when in contact with the table.

In order to releasably retain a suitable food container 42, such as a bowl, on the surface of the tray 36, the tray is provided with a retaining element 44 which includes a threaded portion thereon mateable with the container 42. The retaining element 44 may protrude from the surface of the tray as shown in FIG. 3 or may be recessed within the tray. In one embodiment, the retaining element may be exteriorly threaded and the container interiorly threaded. However, the food container could readily function with interior threads on the retaining element, and exterior threads on the container. The use of mateable threaded portions provides a means of positively locking the food container 42 into position on the tray with a simple rotational movement of the container, or unlocking it from the retaining element through the use of a reverse motion. In addition to the convenience inherent in the use of such a food container, it reduces the amount of spillage of any liquid or solid food matter which may be present within the container when the container is locked or unlocked from the tray. The mateable threads are adapted to be self-aligning, further assuring smooth, positive locking and unlocking of the container to the tray.

An alternative to the use of mateable threaded portions would be the use of protruding pins which would be slidably received by a series of corresponding slots. This bayonet type of attachment may be preferable depending on the molding technique utilized.

The food container 42 should preferably be made of a heat-resistant durable, and stain-resistant plastic, and could be a bowl, plate, cup, or other suitable container.

From the foregoing, it will be appreciated that, although specific embodiments of the invention have been described herein for purposes of illustration, various modifications may be made without departing from the spirit and scope of the invention. Accordingly, the invention is not limited except as by the appended claims.

We claim:

1. A portable infant feeding system for use in conjunction with a substantially flat surface, comprising the combination of:

a hook-on chair, including (1) a pair of substantially parallel frame members, each of said frame members having an upper outwardly extending portion which terminates in a downwardly extending upper end portion and a lower outwardly extending portion which terminates in an upwardly extending lower end portion, said end portions including resilient, anti-skid caps thereon for engaging the surface and positioned to substantially oppose one another when placed on opposite sides of said surface in counter-balanced fashion; (2) a seat positioned substantially parallel to the plane of said surface and extending transverse to and releasably coupled to said frame members; (3) an upwardly extending back, said back positioned in substantially perpendicular relation to the plane of said surface and extending transverse to said releasably coupled to said frame members; and a tray, having openings therein adapted to receive said upper-end caps of said frame members, the caps and openings shaped such that the caps apply substantial downward pressure on the sidewalls of the openings in the tray on compression of the caps by the weight of an infant placed in the chair to lock the tray in place without affecting the anti-skid characteristics of the caps in contact with the surface, said tray having retaining means thereon for releasably retaining a suitable container.

2. The system as defined in claim 1 wherein said retaining means includes a threaded portion mateable with said container.

3. The system as defined in claim 2 wherein said retaining means includes exterior threads mating with interior threads on said container.

4. The system as defined in claim 2 wherein said container is a bowl.

5. The system as defined in claim 1 including a safety strap, said safety strap detachably coupled to said frame and extending across said seat for holding an infant in place in the seat.

6. The system as defined in claim 5 wherein said safety strap includes a center strap, said center strap detachably coupled to said seat and adapted to slidably retain said safety strap substantially adjacent to said seat.

* * * * *